US009577341B2

(12) United States Patent
Parsche

(10) Patent No.: US 9,577,341 B2
(45) Date of Patent: Feb. 21, 2017

(54) MICROCELLULAR COMMUNICATIONS ANTENNA AND ASSOCIATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 297 days.

(21) Appl. No.: 14/077,491

(22) Filed: Nov. 12, 2013

(65) Prior Publication Data

US 2015/0130675 A1 May 14, 2015

(51) Int. Cl.

| | |
|---|---|
| ***H01Q 11/02*** | (2006.01) |
| ***H01Q 13/26*** | (2006.01) |
| ***H01P 3/10*** | (2006.01) |
| ***H01Q 11/08*** | (2006.01) |
| ***H01Q 13/28*** | (2006.01) |
| *H01Q 13/20* | (2006.01) |

(52) U.S. Cl.

CPC ..... *H01Q 13/26* (2013.01); *H01P 3/10* (2013.01); *H01Q 11/083* (2013.01); *H01Q 13/28* (2013.01)

(58) Field of Classification Search

CPC ..... H01Q 13/28; H01Q 13/26; H01Q 1/286; H01Q 9/42; H01Q 13/203; H01Q 21/20; H01Q 1/34; H01Q 1/38; H01Q 13/06; H01Q 13/20; H01Q 11/02; H01P 3/02; H01P 3/10; H01P 3/06; H01P 3/00

USPC ..... 343/731, 739, 785, 790, 895, 905, 803,343/795, 786; 455/41.1, 41.2

See application file for complete search history.

(56) References Cited

U.S. PATENT DOCUMENTS 2,167,735 A * 8/1939 Alford ..... H01Q 1/34 343/731
2,293,753 A * 8/1942 Lindenblad ..... H01Q 11/02 343/731
2,659,004 A * 11/1953 Lindenblad ..... H01Q 1/286 343/705

(Continued)

FOREIGN PATENT DOCUMENTS

| | | |
|---|---|---|
| EP | 1087463 | 3/2001 |
| FR | 1185010 | 7/1959 |

OTHER PUBLICATIONS

Friedman et al., "Low-loss RF transport over long distances", IEEE Transaction on Microwave Theory and Techniques, vol. 49, No. 2, Feb. 2001, pp. 341-348.

(Continued)

*Primary Examiner* — Dameon E Levi
*Assistant Examiner* — Awat Salih
(74) *Attorney, Agent, or Firm* — Allen, Dyer, Doppelt, Milbrath & Gilchrist, P.A. Attorneys at Law

(57) ABSTRACT

A radio frequency (RF) communications system includes a local RF communications device and an RF antenna including a conical RF launch structure coupled to the local RF communications device, and an elongate electrical conductor having a proximal end coupled to the conical RF launch structure and a distal end spaced apart from the conical RF launch structure to define an elongate RF coverage pattern. The elongate conductor may be a coaxial cable. At least one remote RF communications device, within the elongate RF coverage pattern, wirelessly communicates with the local RF communications device.

24 Claims, 7 Drawing Sheets

(56) References Cited

U.S. PATENT DOCUMENTS 2,663,797 A * 12/1953 Kock ..... H01Q 13/28 333/34
2,685,068 A * 7/1954 Goubau ..... H01P 3/10 333/21 R
2,688,732 A * 9/1954 Kock ..... H01P 3/10 333/137
2,921,277 A 1/1960 Goubau
3,624,658 A * 11/1971 Voronoff ..... H01Q 9/27 343/739
4,743,916 A * 5/1988 Bengeult ..... H01Q 13/20 343/707
4,772,891 A * 9/1988 Svy ..... H01Q 1/30 343/707
4,786,911 A 11/1988 Svy
4,797,681 A * 1/1989 Kaplan ..... H01Q 13/0258 333/137
4,864,318 A * 9/1989 Iwasaki ..... H01Q 9/20 174/115
5,067,173 A 11/1991 Gordon et al.
5,172,129 A * 12/1992 Bouko ..... H01Q 21/24 343/756
5,280,472 A 1/1994 Gilhousen et al.
5,369,801 A 11/1994 Smith
5,424,864 A 6/1995 Emura
5,602,834 A 2/1997 Dean et al.
5,627,879 A 5/1997 Russell et al.
5,642,405 A 6/1997 Fischer et al.
5,943,025 A * 8/1999 Benham ..... H01Q 9/28 343/795
5,990,835 A 11/1999 Kuntzsch et al.
6,097,931 A 8/2000 Weiss et al.
6,112,086 A 8/2000 Wala
6,396,600 B1 5/2002 Davies
6,459,909 B1 10/2002 Bilcliff et al.
6,836,660 B1 12/2004 Wala
7,009,471 B2 3/2006 Elmore
7,154,430 B1 * 12/2006 Buehler ..... G01S 7/38 342/13
7,345,623 B2 * 3/2008 McEwan ..... G01F 23/284 342/124
7,567,154 B2 * 7/2009 Elmore ..... H01P 3/10 333/21 R
8,237,617 B1 * 8/2012 Johnson ..... H01Q 13/26 343/785
8,830,112 B1 * 9/2014 Buehler ..... G01S 7/38 342/13
2004/0135732 A1 7/2004 Volman
2005/0258920 A1 * 11/2005 Elmore ..... H01P 3/10 333/240
2012/0026051 A1 * 2/2012 Nilsson ..... H01Q 1/36 343/752

OTHER PUBLICATIONS

Times Microwave Systems, "T-RAD-600 Leaky Feeder Coaxial Cables", catalog, 4 pps., TRAD600 Mar. 7, 2007. www.timesmicrowave.com.
Goubau, "Surface Waves and Their Application to Transmission Lines", J. Appl. Phys. 21, 1119, 1950, abstract.
Tan et al., "UTD Propagation Model in an Urban Street Scene for Microcellular Communications", Electromagnetic Compatibility, IEEE, vol. 35, Issue 4, Nov. 1993, abstract.
Garcia Sanchez et al., "Microcellular Propagation Modeiling Including Antenna Pattern and Polarization", Antennas and Propagation Society International Symposium, 1995. AP-S. Digest, vol. 118-23 Jun. 1995, abstract.
Kim-Fung et al., "Radiosity Method: A New Propagation Model for Cellular Communication", Antennas and Propagation Society International Symposium, 1998. IEEE, vol. 4, Jun. 21-26, 1998, abstract.
Weber et al., "Wireless Indoor Positioning: Localization Improvements With a Leaky Coaxial Cable Prototype", 2011 International Conference on Indoor Positioning and Indoor Navigation (IPIN), Sep. 21-23, 2011, Gumaraes, Portugal, 3 pps.

* cited by examiner

MICROCELLULAR COMMUNICATIONS ANTENNA AND ASSOCIATED METHODS

FIELD OF THE INVENTION

The present invention relates to the field of communications and, more particularly, to wireless communications and related methods.

BACKGROUND OF THE INVENTION

Current cell towers provide free space radiation and directional antenna sectors. The required narrow antenna beams to cover only a highway cannot be realized at 698 to 2700 MHz cellular frequencies. For example, for a 10 mile long by 100 foot wide highway coverage cell, the beamwidth required is $\tan^{-1}$ (100/52800)=0.11 degrees, which may require a 65 dBi gain antenna hundreds of wavelengths diameter. Additionally, the resulting cell would not be rectangular, but triangular shaped and the signal strength not uniform. Other problems with towers include unreachable spaces (building interiors, tunnels, backside of hills), cannot realize a strip shaped coverage cell, will not provide road only coverage, cells cannot follow a turn in a road, limited frequency reuse, low security and too far for self powered RFID.

A single-wire transmission line (SWTL or single wire method) is a method of transmitting electrical power or signals using only a single electrical conductor. In a publication by Georg Goubau, entitled "Surface waves and their Application to Transmission Lines," Journal of Applied Physics, Volume 21, November (1950), a surface wave mode along a wire is discussed. Electric and magnetic fields along the wire were linearly polarized, e.g. they did not rotate about the wire axis as would rotationally polarized fields.

In U.S. Pat. No. 2,685,068 entitled "Surface Wave Transmission Line" Goubau proposed the application of a dielectric layer surrounding the wire. Even a rather thin layer (relative to the wavelength) of a dielectric will reduce the propagation velocity sufficiently below the speed of light, eliminating radiation loss from a surface wave along the surface of a long straight wire. This modification also had the effect of greatly reducing the radial footprint of the electromagnetic fields surrounding the wire, addressing the other practical concern. Radiation from the wire was not for wireless communication and a separate radiating antenna was provided. The separate radiating antenna was wired to the SWTL to exchange conducted electric currents. Electric and magnetic fields along the wire were linearly polarized.

In U.S. Pat. No. 2,921,277 entitled "Launching and Receiving of Surface Waves" Goubau also proposed a method for launching (and receiving) electrical energy from such a transmission line. The Goubau line (or "G-line") includes a single conductor coated with dielectric material. At each end is a wide disk with a hole in the center through which the transmission line passes. The disk may be the base of a cone, with its narrow end connected typically to the shield of coaxial feed line, and the transmission line itself connecting to the center conductor of the coax. Even with the reduced extent of the surrounding fields in Goubau's design, such a device only becomes practical at UHF frequencies and above. Wireless communication by wire radiation was not described.

More recently, a product has been introduced under the name "E-Line" which uses a bare (uncoated) wire, but employs the cone launchers developed by Goubau. Thus, the resulting wave velocity is not reduced by a dielectric coating, however the resulting radiation losses may be tolerable for the transmission distances intended. The intended application in this case is not power transmission but power line communication, that is, creating supplementary radio frequency channels using existing power lines for communications purposes. This has been proposed for transmission of frequencies from below 50 MHz to above 20 GHz using pre-existing single or multi-strand overhead power conductors. Communications to mobile units was not described.

For example, U.S. Pat. No. 7,009,471 entitled "Method and Apparatus for Launching a Surfacewave onto a Single Conductor Transmission Line Using a Slotted Flared Cone" to Elmore discloses an apparatus for launching a surfacewave onto a single conductor transmission line that provides a launch including a flared, continuously curving cone portion, a coaxial adapter portion, and a wire adapter portion for contacting the wire conductor which allows for a multiplicity of wire dimensions for either insulated or uninsulated wire, or a tri-axial wire adapter device enabling non-contacting coupling to a wire. A longitudinal slot is added to the flared cone, wire adapter, and coaxial adapter portions of the launch to allow direct placement of the launch onto existing lines, without requiring cutting or threading of those lines for installation.

Also, U.S. Pat. No. 7,567,154 entitled "Surface Wave Transmission System Over a Single Conductor Having E-fields Terminating Along the Conductor" to Elmore discloses a low attenuation surface wave transmission line system for launching surface waves on a bare and unconditioned conductor, such as are found in abundance in the power transmission lines of the existing power grids. The conductors within the power grid typically lack dielectric and special conditioning. A first launcher, preferably includes a mode converter and an adapter, for receiving an incident wave of electromagnetic energy and propagating a surface wave longitudinally on the power lines. The system includes at least one other launcher, and more likely a number of other launchers, spaced apart from one another along the constellation of transmission lines. The system and associated electric fields along any given conductor are radially and longitudinally symmetrical.

It may be desirable to obtain precise communications coverage areas, for frequency reuse, communications privacy, and security needs, for example, including microcellular telephone coverage, communications, especially communications to mobile units, and communications inside mines, tunnels, buildings, or hallways, or for Radio Frequency Identification Device (RFID) tracking.

SUMMARY OF THE INVENTION

In view of the foregoing background, it is therefore an object of the present invention to provide a microcellular communications antenna with a more precisely shaped coverage area.

This and other objects, features, and advantages in accordance with the present invention are provided by a radio frequency (RF) communications system comprising a local RF communications device and an RF antenna including a conical RF launch structure coupled to the local RF communications device, and an elongate electrical conductor having a proximal end coupled to the conical RF launch structure and a distal end spaced apart from the conical RF launch structure to define an elongate RF coverage pattern. The elongate conductor may be a coaxial cable. At least one remote RF communications device, within the elongate RF coverage pattern, wirelessly communicates with the local RF communications device.

The conical RF launch structure comprises a curved electrical conductor defining a conical helix. Such curved electrical conductor has a proximal end at an apex of the conical helix and a distal end at a base of the conical helix. The local RF communications device has a first terminal coupled to the proximal end of the curved electrical conductor and a second terminal coupled to the proximal end of the elongate electrical conductor.

An electrically conductive shield may be coupled to the proximal end of the curved electrical conductor. Also, at least one termination load may be coupled to the distal end of the elongate electrical conductor. Such a termination load may include a plurality of terminal resistors coupled together in series with corresponding resistance values increasing away from the distal end of the elongate electrical conductor.

A plurality of spaced apart antennas may be coupled to the elongate electrical conductor. Each of the antennas may be a u-shaped folded dipole. Also, a plurality of spaced apart repeaters may be coupled to the elongate electrical conductor.

A method aspect is directed to a method for establishing an elongate radio frequency (RF) coverage pattern comprising coupling a proximal end of an elongate electrical conductor to a conical RF launch structure and positioning a distal end of the elongate electrical conductor in spaced apart relation from the conical RF launch structure to define the elongate RF coverage pattern to permit wireless communication between a local RF communications device coupled to the conical RF launch structure and at least one remote RF communications device within the elongate RF coverage pattern.

The method may also include forming the conical RF launch structure with a curved electrical conductor defining a conical helix, and coupling an electrically conductive shield to a proximal end of the curved electrical conductor. The method may further include coupling at least one termination load to the distal end of the elongate electrical conductor, and coupling a plurality of spaced apart antennas to the elongate electrical conductor. A plurality of spaced apart repeaters may be coupled to the elongate electrical conductor.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1A:
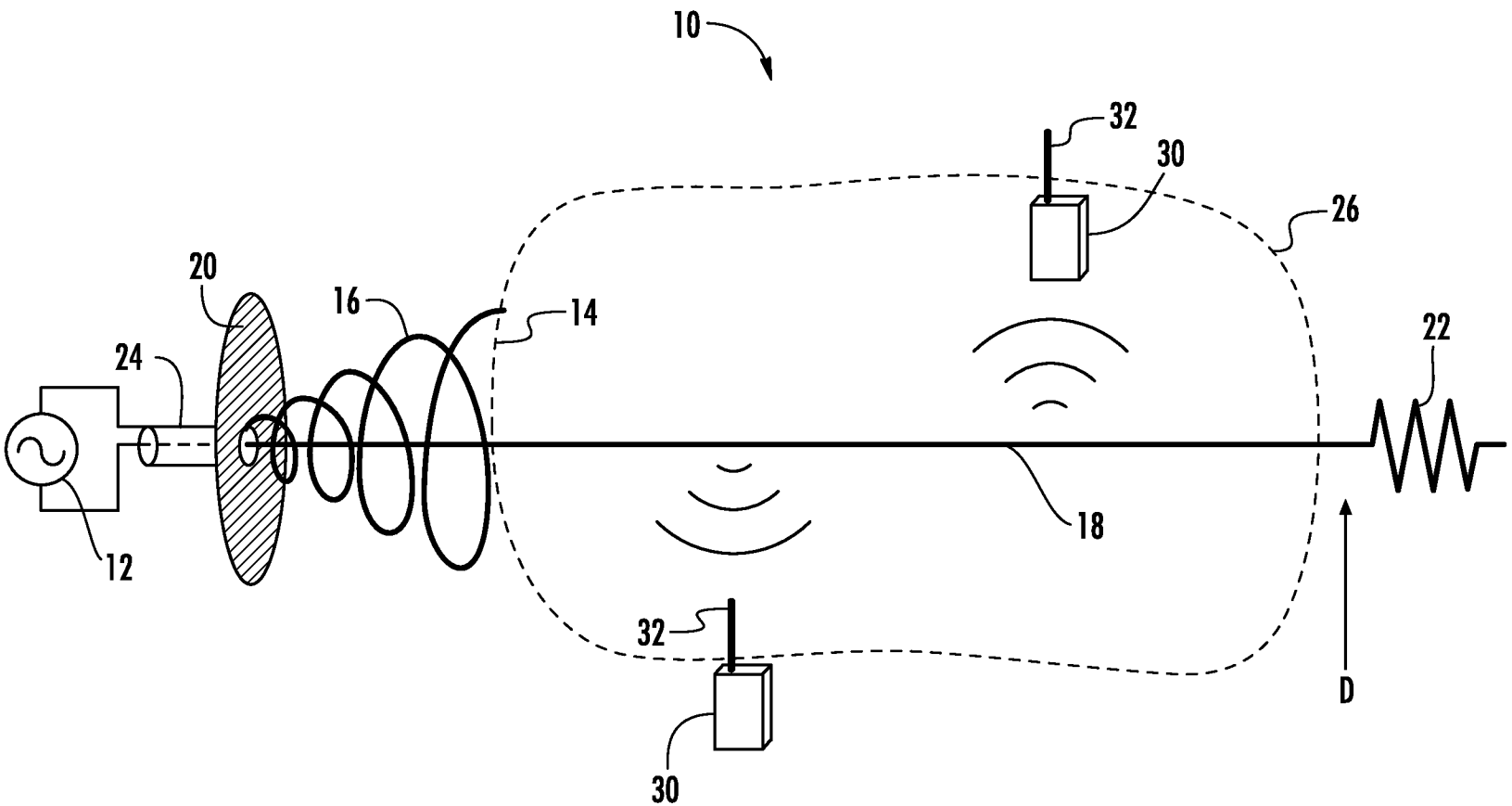
FIG. 1A is a schematic diagram illustrating a radio frequency (RF) communications system according to a present embodiment.
Figure 1B:
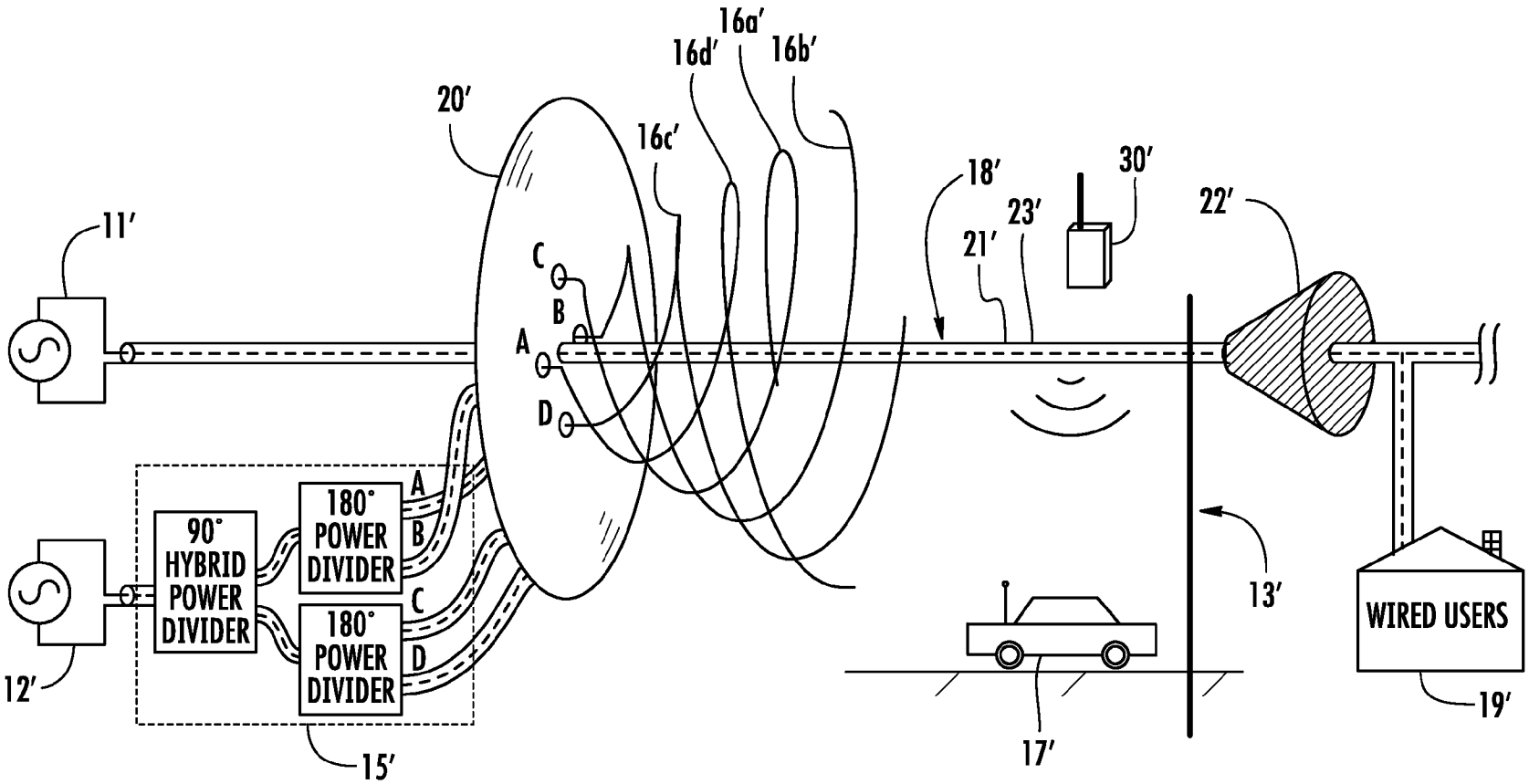
FIG. 1B is a schematic diagram illustrating an alternative embodiment radio frequency (RF) communications system for coaxial cable elongate conductors.
Figure 2:
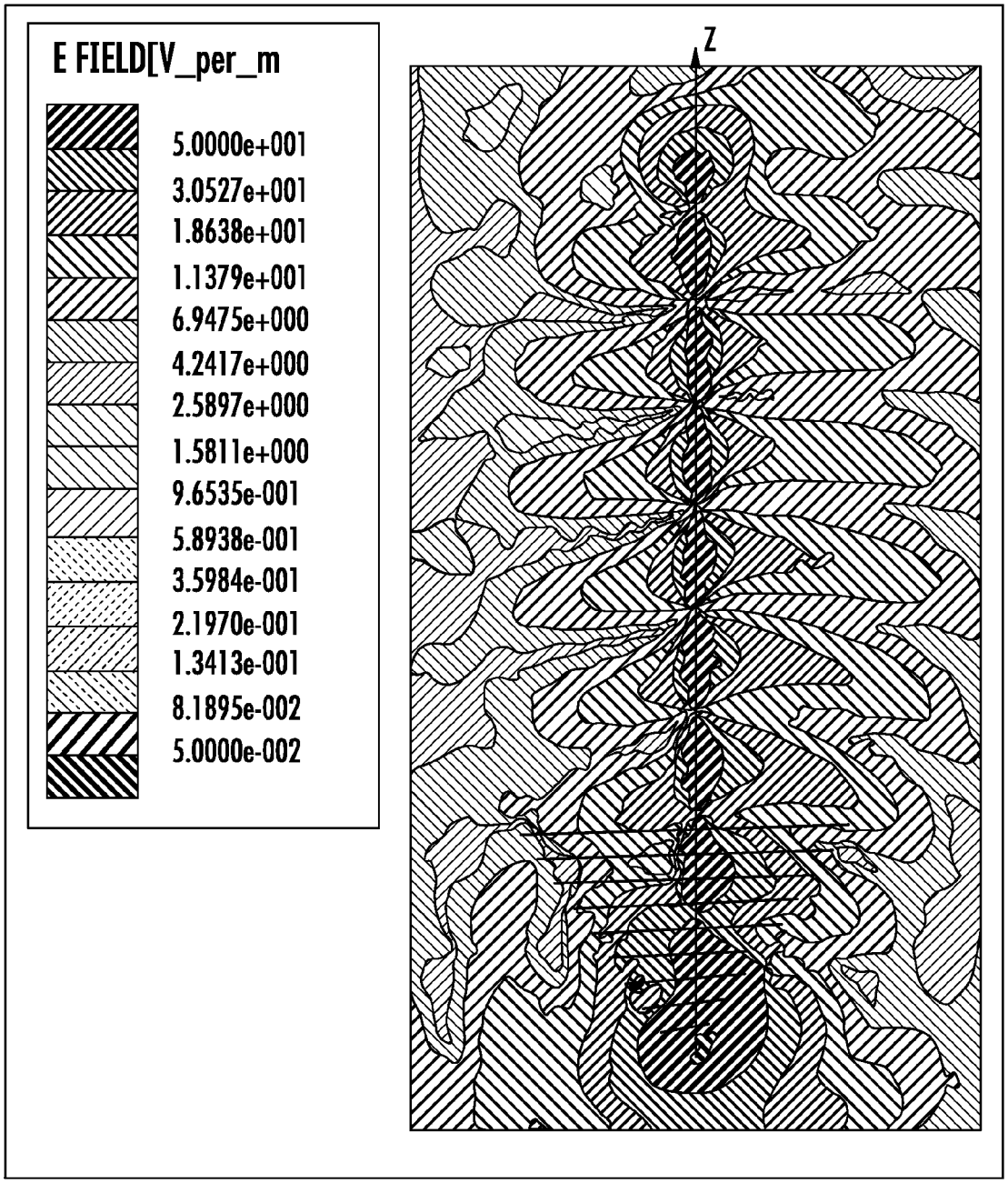
FIG. 2 is a schematic graph illustrating the E fields and the elongate RF coverage pattern of the system in FIG. 1.
Figure 3:
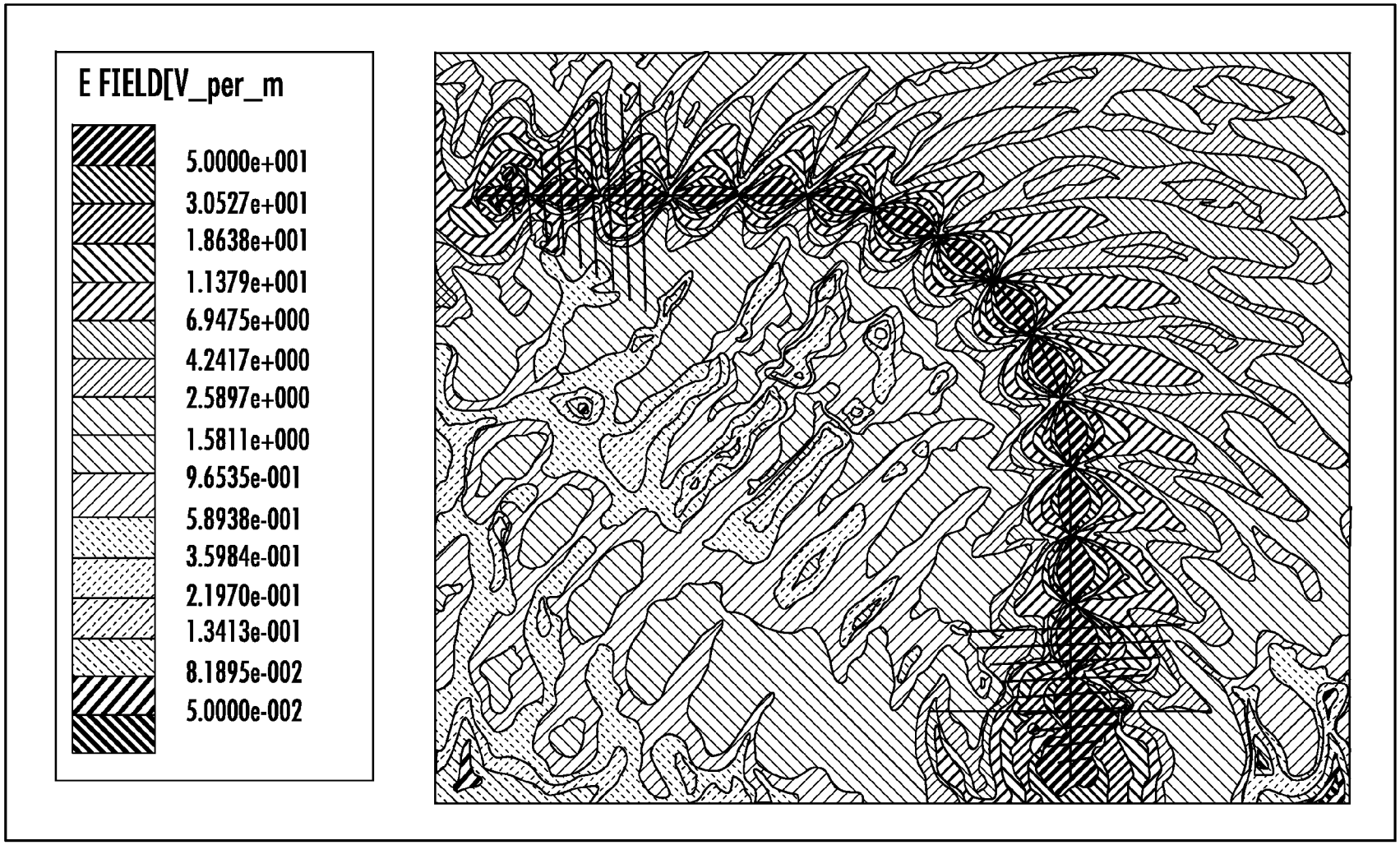
FIG. 3 is a schematic graph illustrating the E fields and the elongate RF coverage pattern of the system in FIG. 1.

Referring initially to FIGS. 1-3, a radio frequency (RF) communications system 10 in accordance with the present embodiments will be described. The RF communications system 10 includes a local RF communications device 12 and an RF antenna 14 including a cable 24 coupling a conical RF launch structure 16 to the local RF communications device 12, and an elongate electrical conductor 18 having a proximal end coupled to the conical RF launch structure 16 and a distal end D spaced apart from the conical RF launch structure 16 to define an elongate RF coverage pattern 26 (e.g. as shown in FIGS. 2 and 3). At least one remote RF communications device 30, within the elongate RF coverage pattern, wirelessly communicates with the local RF communications device 12. Although only transmission or reception may be recited, it is understood here that radio frequency communications system 10 can provide bidirectional communications, e.g. both transmit and receive.

The remote RF communications device 30 is preferably a mobile two-way RF communications device having voice and data communications capabilities, such as a cellular telephone or smart phone, for example. Other wireless devices, such as RFID tags, are also contemplated as the remote RF communications device 30. The remote RF communications device 30 may be mounted in an automobile 17. The remote RF communications device 30 may use many types of remote antennas 32, such as half wave dipole antennas, whip antennas, loops, microstrip patch or planar inverted F (PIFA) antennas. The remote antenna 32 need not be a horn launcher, nor need it be concentric around the elongate electrical conductor 18, nor need it be conductive electrical contact with the elongate electrical conductor 18, although these could be used if desired.

The remote RF communications device 30 can be loosely coupled electromagnetically to the elongate electrical conductor 18 so that many remote RF communications devices 30 are operable at once. In other words, the capture area of the antenna 32 may be small and only a tiny amount of electromagnetic energy intercepted off the elongate conductor 18. Loose coupling levels may range from say −10 to −160 dB, e.g. $-10\ dB<S_{21}<-160\ dB$, where port 1 is the terminal of the conical RF launch structure 16 and port 2 is the terminals of the antenna 32. Required coupling levels can vary with link budget parameters, including RF power level, receiver sensitivity, bandwidth, required quality of service, etc. Tighter coupling levels may be used for operation of wireless powered remote RF communications devices 30 that obtain their prime operating power from electromagnetic energy surrounding elongate electrical conductor 18. Thus the system 10 may provide also single conductor electrical power delivery.

The elongate RF coverage pattern provides a precise communications coverage area such as for microcellular telephone coverage, or communications inside mines, tunnels, buildings, or hallways, or for RFID tracking. The elongate electrical conductor 18 guides the waves to shape the coverage area. The elongate electrical conductor 18 can be routed where the coverage is desired, e.g. around a smooth bend as illustrated in FIG. 3. The electromagnetic waves follow the elongate electrical conductor 18, or wire, as a surface wave due to continuous refraction and traveling wave physics. Examples of elongate electrical conductors 18 may include metal wires, metal railings, metal tracks, metal pipes, a carbon fiber, a conductive tape, or even the wires of a high voltage electrical power line.

The conical RF launch structure 16 may be a broadband conical helix launcher and comprise a curved electrical conductor defining a conical helix. Such curved electrical conductor has a proximal end at an apex of the conical helix and a distal end at a base of the conical helix. The local RF communications device 12 has a first terminal coupled to the proximal end of the curved electrical conductor and a second terminal coupled to the proximal end of the elongate electrical conductor 18. An electrically conductive shield 20 may be coupled to the proximal end of the curved electrical conductor of the conical RF launch structure 16. The electrically conductive shield 20 may be a circular metal plate that eliminates unwanted radiation off the end of the elongate electrical conductor 18 such as in a reflector or backfire mode.

Referring to now FIG. 1B, an alternate embodiment 10' of the apparatus will now be described. Structures in FIG. 1B may not proportional in order to provide a more detailed depiction. The FIG. 1B alternate embodiment 10' embodiment uses a coaxial cable elongate electrical conductor 18' to provide two communications modes: 1) a wired service for wired subscribers only, and 2) a wireless communications service for fixed, portable or mobile subscribers. The information carried on the wired mode and wireless mode may be the same or different, as electrical isolation exists between the transmission modes on the inside of the coaxial cable and the transmission modes on the outside of the coaxial cable. In the FIG. 1B embodiment the interior of the coaxial cable elongate electrical conductor 18' can function as a conventional coaxial cable and the cable exterior can guide surface waves from the conical RF launch structure 16'.

Continuing to refer to FIG. 1B, a coaxial elongate electrical conductor 18' has a conductive inner conductor 23' and a conductive outer shield conductor 21'. A dielectric coating may or may not present over the coaxial elongate electrical conductor 18'; both coated and uncoated coaxial elongate electrical conductors 18' are useful for the embodiments of the invention. Conductive outer shield conductors 21' may include solid metal tubes, braided metal wires, metal foil, or even conductive paint. The coaxial elongate electrical conductor 18' may be for example a new or legacy cable television service coaxial cable supported by utility poles 13'. Wireless RF communications device 12' provides the wireless service and the wired RF communications device 11' provides the wired service. A usage example includes the wireless RF communications device 12' providing cellular telephone service, and wired RF communications device 11' providing cable television programming. Another usage example includes the wireless RF communications service 12' being mobile data service for personal electronic devices (PEDS), and wired RF communications device 11' being fixed data service to homes. The FIG. 1B embodiment may advantageously provide "last mile" bandwidth distribution in residential areas using new or legacy coaxial cables.

Continuing the FIG. 1B embodiment, reflector 20' may be formed of two sheet metal halves and joined together over the coaxial elongate electrical conductor 18'. One or more wired subscribers 19' may be receive wired services from the wired RF communications device 11' by using one or more power dividing taps on the coaxial elongate electrical conductor 18'. Absorber 22' may be located where it is desired to terminate or suspend wireless service. Absorber 22' may be a wave absorber such as a cone of graphite loaded polyurethane foam. One or more conical RF launch structures 16*a*'-16*d*' may be used. More than one conical RF launch structure improves rotational polarization circularity. FIG. 1B shows, for example, 4 conical RF launch structures 16*a*', 16*b*', 16*c*', 16*d*' fed with 0, 90, 180 and 270 degree phasing respectively from the phasing matrix 15'. Reference indicators A, B, C, D are the index to the coaxial cable harness connections between the phasing network and the 4 conical RF launch structures. Phasing network 15' may be a Butler Matrix type phasing network to provide the quadrature (0, 90, 180 and 270 degree) phasing. Of course other numbers of arms and phasing increments may be used, such as say a two arm spiral at 0, 180 degrees phase.

Examples of useful dimensions for the conical RF launch structure 16, 16' will now be described. At the lowest desired frequency of operation the large end or "mouth" of the conical RF launch structure 16, 16' can be $d=0.68\lambda_c$ in diameter. The length can be $l=0.59\lambda_c$, where $\lambda_c$ is the wavelength at the lowest frequency of operation calculated as $\lambda_c=c/f_c$, where c is the speed of light in meters per second and $_{fc}$ the lowest desired operating frequency in cycles per second. The conical helix is wound of copper wire on a 49 degree hollow fiberglass or polystyrene cone. The number of turns is 14 and a progressively tighter pitch is used towards the small end of the cone. Metal tape windings (not shown) of logarithmically increasing width may also comprise the winding, e.g. a log spiral winding. Electrically conductive shield 20, 20' is a circular brass plate $d=0.9_{\lambda c}$ wavelengths in diameter. Other surface wave launch structures 16, 16' may be used. The conical RF launch structure 16, 16' is a high pass device providing many octaves of bandwidth above a lower cutoff frequency. Many dimensional trades are possible.

The conical RF launch structure 16, 16' advantageously provides an electrical impedance transformation between the wave impedance of the fields guided the elongate electrical conductor 18, 18' and the circuit impedance of the local RF communications device 15, 11', 12'. For an elongate electrical conductor 18 having a smooth bare surface, the guided wave impedance may be similar to free space and 377 ohms. The local RF communications device 15 source/load impedance may be any; however 50 ohms may be preferred for convention. In such an embodiment the impedance transformation ratio of the conical RF launch structure 16 is 377/50=7.5 to 1.

Impedance matching provisions in the conical RF launch structure 16, 16' may include: tapering the wire gauge throughout the winding, tapering the width of a tape conductor winding, varying the diameter of the elongate electrical conductor 18, 18' inside the conical RF launch structure 16, 16', e.g. a bulge there, varying the winding envelope away from conical, e.g. an exponential or logarithmic cone taper, dielectric fills, etc. At higher frequencies, where conical RF launch structure 16, 16' overall size may be small, impedance transformation can be improved by a long conical RF launch structure, such as a 5 or 10 degree cone form instead of a 49 degree cone form. Dielectric and magnetic coatings on the elongate electrical conductor 18, 18', such as Teflon or ferrite, may vary the surface wave impedance away from 377 ohms and the radial extent of the fields surrounding the elongate conductor.

A conical helix surface wave launch structure 16, 16' may cause a rotationally polarized surface wave to attach and propagate along the elongate electrical conductor 18, 18'. Here the term rotationally polarized fields is understood to include elliptically polarized fields, circularly polarized fields or both.

In addition, a traveling wave current distribution may convey on the length of the elongate electrical conductor 18, 18'. There current maximas, e.g. "lumps of current", move along at near the speed of light. Radio frequency (RF) communications system 10, 10' may advantageously generate a rotationally polarized mode of surface wave propagation along the elongate electrical conductor 18, 18'.

Figure 4:
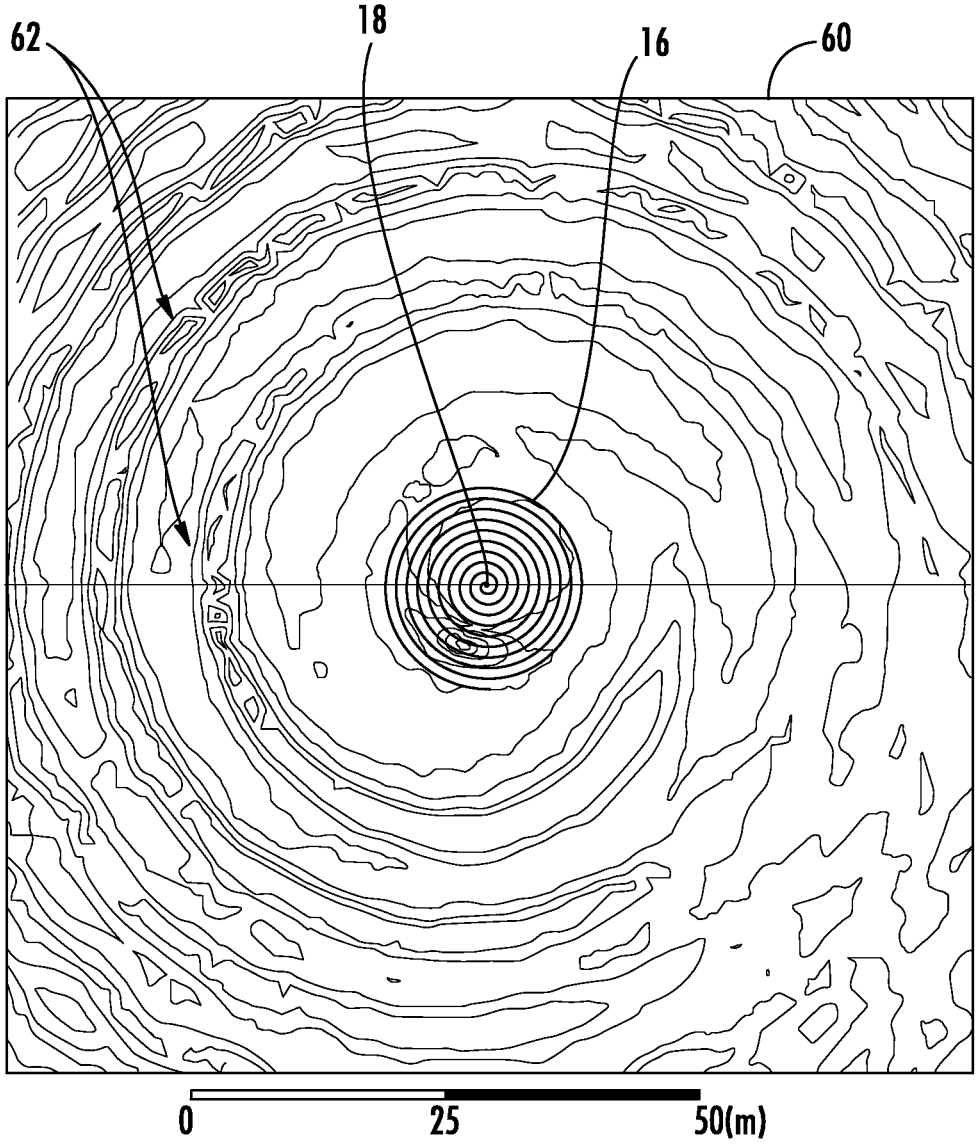
FIG. 4 is a cross sectional view of circularly polarized magnetic fields rendered according to the system in FIG. 1.

Referring to FIG. 4, cross sectional cut 60, magnetic field strength contours 62 at an intermediate point along the elongate electrical conductor 18, 18' will now be described. Conical RF launch structure 16, 16' is seen in profile in the center and the elongate electrical conductor 18, 18' is oriented out of the page. Electrically conductive shield 20, 20' is present but not shown for clarity. The contours were obtained by finite element simulation and are for an instant in time without any averaging. As can be seen, the magnetic field strength contours 62, 62' are curling to resemble Archimedean spirals so the magnetic flux lines may be Archimedean spirals as well. The spiraling magnetic fields rotate in time about the elongate electrical conductor 18, 18' as the excitation phase advances and the electromagnetic energies propagate.

As background, magnetic field strength contours for a linear polarization (not shown) produced by a solid metal cone conical RF launch structure 16, 16' (not shown) would be closed circles instead of spirals. The spiral winding of the conical launch structure 16, 16' may advantageously provide rotational polarization about the elongate electrical conductor 18, 18', which may be preferential for say reduced fading to the remote RF communication devices 20, 20'.

Also, to reduce and/or eliminate the reflection of current or wave patterns, at least one termination load 22, 22' may be coupled to the distal end D of the elongate electrical conductor 18, 18'. Such a termination load 22, 22' may include a plurality of terminal resistors coupled together in series with corresponding resistance values increasing away from the distal end D of the elongate electrical conductor 18, 18'. For example, eight terminal resistors having resistor values of 10, 20, 40, 80, 160, 320, 640, and 1280 ohms may be used. Wave absorber termination examples include a cone base 1.5 wavelengths in diameter, a cone length 2 wavelengths long, and a material bulk electrical conductivity of 0.04 mhos/meter. The elongate electrical conductor 18, 18' may run through the length of a conical graphite loaded foam termination 22, 22'.

Figure 5:
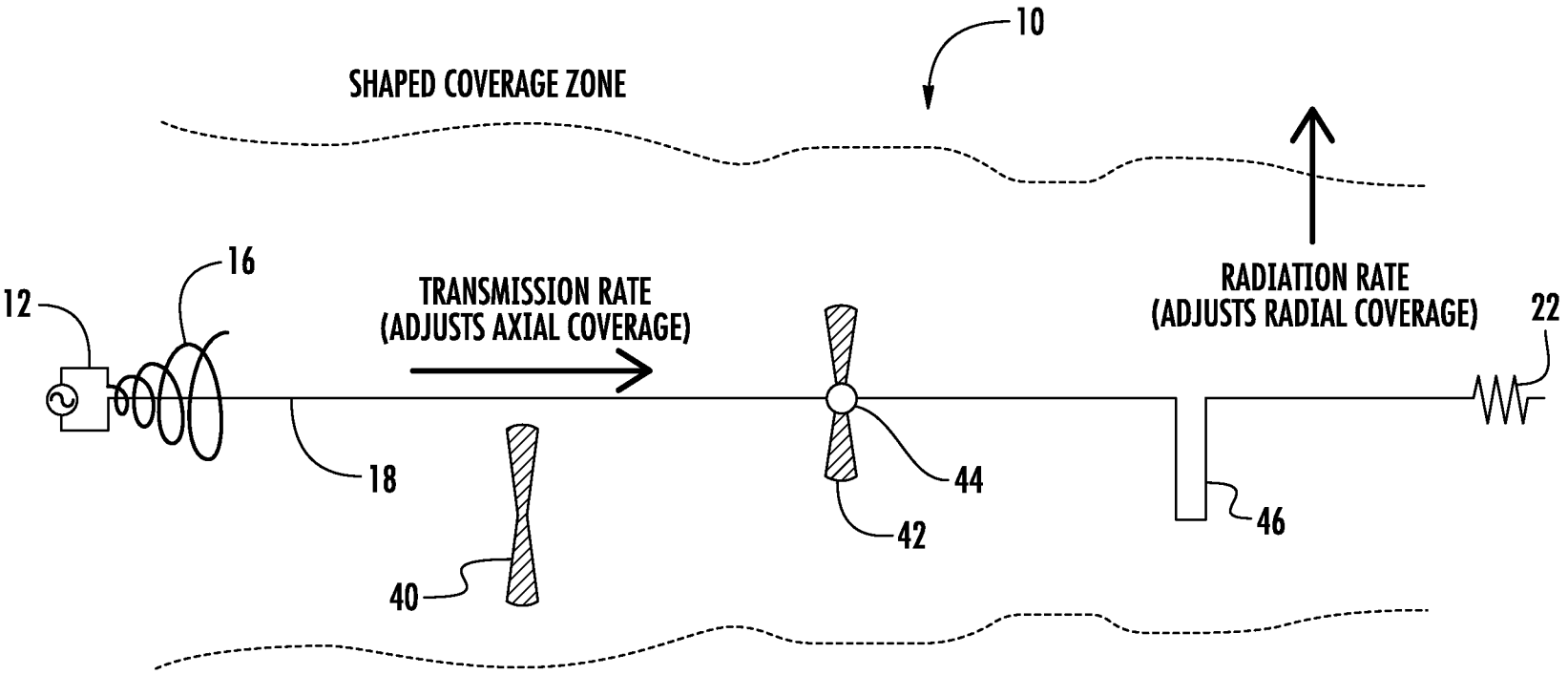
FIG. 5 is a schematic diagram illustrating a radio frequency (RF) communications system according to another embodiment.

Referring to FIG. 5, uniform signal strength may be possible throughout the coverage area by progressively increasing the radiation rate of the elongate electrical conductor 18 or guide wire. Signal strength contouring may be accomplished by removing wire insulation, changing wire twist or thickness, or adding kinks or knots in the wire. The more radial coverage results in less axial coverage, and vice versa. Adding dielectric or magnetic coatings causes electromagnetic fields to hug closer to the elongate electrical conductor 18, 18' to reduce radial range and increase axial range. Perturbations on the wire increase radiation.

A plurality of spaced apart antennas 40, 42, 44 may be coupled to the elongate electrical conductor 16. For example, series fed U-shaped folded dipole antennas 46 may be spliced into the wire 18. In general, many antenna forms will reradiate if brought into proximity with the elongate electrical conductor 18, for instance wires can hang from the elongate electrical conductor 16 to form radiating dipoles, the structure looking like icicles. Conductive electrical contact is not necessary for the re-radiation. Also, a plurality of spaced apart repeaters may be coupled to or spliced into the elongate electrical conductor 16.

With two elongate conductor propagation modes several synergies are possible. A coaxial elongate electrical conductor 18' may feed one or more than conical RF launch structure 16'. So, there may be many conical RF launch structures 16' spaced apart along the coaxial cable, each one tapping into signals from the inside of coaxial elongate electrical conductor 18' for refeeding the coaxial cable exterior. Alternatively, the coaxial cable exterior mode may re-feed the coaxial cable interior mode at intervals.

Figure 6:
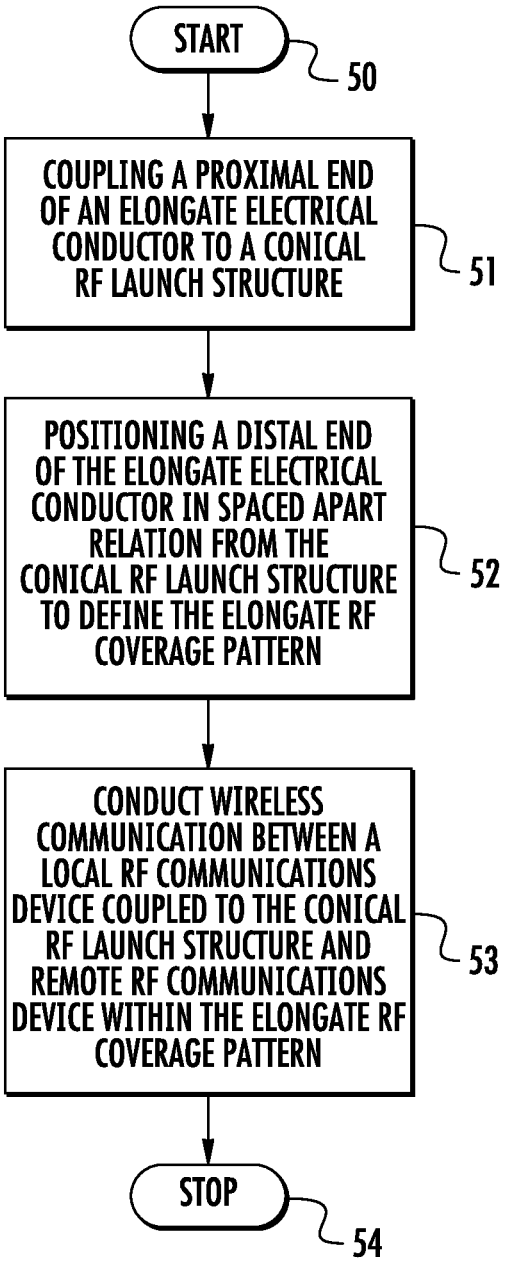
FIG. 6 is a flowchart illustrating steps of a method aspect of the present invention.

With additional reference to FIG. 6, a method aspect is directed to a method for establishing an elongate radio frequency (RF) coverage pattern. The method begins (block 50) and includes coupling a proximal end P of an elongate electrical conductor 18 to a conical RF launch structure 16 (block 51) and positioning a distal end D of the elongate electrical conductor 18 in spaced apart relation from the conical RF launch structure 16 to define the elongate RF coverage pattern (block 52). The method further includes permitting or conducting wireless communication (block 53) between a local RF communications device 12 coupled to the conical RF launch structure 16 and one or more remote RF communications devices 30 within the elongate RF coverage pattern.

The method may also include forming the conical RF launch structure 16 with a curved electrical conductor defining a conical helix, and coupling an electrically conductive shield 20 to a proximal end of the curved electrical conductor. The method may further include coupling at least one termination load 22 to the distal end D of the elongate electrical conductor 18, and coupling a plurality of spaced apart antennas 40, 42, 44 to the elongate electrical conductor 18. A plurality of spaced apart repeaters may be coupled to the elongate electrical conductor. The method may include installing a conical RF launch structure 16' over a coaxial cable elongate electrical conductor 18' to provide communications coverage to one or more remote RF communications devices 30'.

Thus, the above-described embodiments provide a more precisely shaped communications coverage area, for frequency reuse, communications privacy, and security needs, for example, including microcellular telephone coverage, communications inside mines, tunnels, buildings, or hallways, or for Radio Frequency Identification Device (RFID) tracking.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A radio frequency (RF) communications system comprising:

a local RF communications device;

an RF antenna comprising a conical RF launch structure coupled to said local RF communications device, and an elongate electrical conductor having a proximal end coupled to said conical RF launch structure and a distal end spaced apart from said conical RF launch structure to define an elongate RF coverage pattern directly radiating from the elongate electrical conductor itself and having rotational polarization about the elongate electrical conductor;

and at least one remote RF communications device within the elongate RF coverage pattern to wirelessly communicate with said local RF communications device.

2. The RF communications system according to claim 1 wherein said conical RF launch structure comprises a curved electrical conductor defining a conical helix.

3. The RF communications system according to claim 2 wherein said curved electrical conductor has a proximal end at an apex of the conical helix and a distal end at a base of the conical helix.

4. The RF communications system according to claim 3 wherein said local RF communications device has a first terminal coupled to the proximal end of said curved electrical conductor and a second terminal coupled to the proximal end of said elongate electrical conductor.

5. The RF communications system according to claim 3 further comprising an electrically conductive shield coupled to the proximal end of said curved electrical conductor.

6. The RF communications system according to claim 1 further comprising at least one termination load coupled to the distal end of said elongate electrical conductor.

7. The RF communications system according to claim 6 wherein said at least one termination load comprises a plurality of terminal resistors coupled together in series with corresponding resistance values increasing away from the distal end of said elongate electrical conductor.

8. The RF communications system according to claim 1 further comprising a plurality of spaced apart antennas coupled to said elongate electrical conductor.

9. The RF communications system according to claim 8 wherein each of said antennas comprises a U-shape.

10. The RF communications system according to claim 1 further comprising a plurality of spaced apart repeaters coupled to said elongate electrical conductor.

11. A radio frequency (RF) antenna to provide an elongate RF coverage pattern comprising:

a conical RF launch structure configured to be coupled to a local RF communications device; and an elongate electrical conductor having a proximal end coupled to said conical RF launch structure and a distal end spaced apart from said conical RF launch structure to define an elongate RF coverage pattern directly radiating from the elongate electrical conductor itself and having rotational polarization about the elongate electrical conductor to permit wireless communication between the local RF communications device and at least one remote RF communications device within the elongate RF coverage pattern.

12. The RF antenna according to claim 11 wherein said conical RF launch structure comprises a curved electrical conductor defining a conical helix.

13. The RF antenna according to claim 12 wherein said curved electrical conductor has a proximal end at an apex of the conical helix and a distal end at a base of the conical helix.

14. The RF antenna according to claim 13 further comprising an electrically conductive shield coupled to the proximal end of said curved electrical conductor.

15. The RF antenna according to claim 11 further comprising at least one termination load coupled to the distal end of said elongate electrical conductor.

16. The RF antenna according to claim 11 further comprising a plurality of spaced apart antennas coupled to said elongate electrical conductor.

17. The RF antenna according to claim 11 further comprising a plurality of spaced apart repeaters coupled to said elongate electrical conductor.

18. The RF antenna according to claim 11 wherein said elongate electrical conductor comprises a coaxial cable.

19. A method for establishing an elongate radio frequency (RF) coverage pattern comprising:

coupling a proximal end of an elongate electrical conductor to a conical RF launch structure and positioning a distal end of the elongate electrical conductor in spaced apart relation from the conical RF launch structure to define the elongate RF coverage pattern directly radiating from the elongate electrical conductor itself and having rotational polarization about the elongate electrical conductor to permit wireless communication between a local RF communications device coupled to the conical RF launch structure and at least one remote RF communications device within the elongate RF coverage pattern.

20. The method according to claim 19 further comprising forming the conical RF launch structure with a curved electrical conductor defining a conical helix.

21. The method according to claim 19 further comprising coupling an electrically conductive shield coupled to a proximal end of the curved electrical conductor.

22. The method according to claim 19 further comprising coupling at least one termination load to the distal end of the elongate electrical conductor.

23. The method according to claim 19 further comprising coupling a plurality of spaced apart antennas to the elongate electrical conductor.

24. The method according to claim 19 further comprising coupling a plurality of spaced apart repeaters to the elongate electrical conductor.

* * * * *